US007354294B2

(12) United States Patent
Kawate et al.

(10) Patent No.: US 7,354,294 B2
(45) Date of Patent: Apr. 8, 2008

(54) COAXIAL CABLE CONNECTOR, AND HARNESS UNIT THAT UTILIZES THE COAXIAL CABLE CONNECTOR

(75) Inventors: Yoshihisa Kawate, Kanagawa (JP); Hiroyuki Matsuoka, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 357 days.

(21) Appl. No.: 10/549,960

(22) PCT Filed: Mar. 16, 2004

(86) PCT No.: PCT/US2004/008104

§ 371 (c)(1),
(2), (4) Date: Oct. 20, 2005

(87) PCT Pub. No.: WO2004/095645

PCT Pub. Date: Nov. 4, 2004

(65) Prior Publication Data

US 2007/0155230 A1 Jul. 5, 2007

(30) Foreign Application Priority Data

Apr. 10, 2003 (JP) ..... 2003-106832

(51) Int. Cl.
*H01R 11/20* (2006.01)

(52) U.S. Cl. ..... 439/394; 439/579; 439/417

(58) Field of Classification Search ..... 439/578, 439/499, 497, 581, 417, 579, 394
See application file for complete search history.

(56) References Cited

U.S. PATENT DOCUMENTS 4,902,242 A * 2/1990 Davis et al. ..... 439/404
5,536,182 A * 7/1996 Atoh et al. ..... 439/404
5,761,805 A * 6/1998 Guyer ..... 29/883
5,766,033 A * 6/1998 Davis ..... 439/405
6,019,625 A * 2/2000 Nimura et al. ..... 439/259
6,050,859 A * 4/2000 Abe et al. ..... 439/701
6,273,745 B1 * 8/2001 Yeh ..... 439/404
6,579,115 B2 * 6/2003 Mitsugi ..... 439/417
6,939,164 B2 * 9/2005 Noro ..... 439/492
7,001,213 B2 * 2/2006 Kaneko et al. ..... 439/579

(Continued)

FOREIGN PATENT DOCUMENTS

EP 0419038 3/1991

(Continued)

*Primary Examiner*—Neil Abrams
*Assistant Examiner*—Phuongchi Nguyen
(74) *Attorney, Agent, or Firm*—Melanie G. Gover

(57) ABSTRACT

A coaxial cable connector can be easily fitted to one or a plurality of coaxial cables, and that can secure an independent shield. Inner insulator exposed portions and outer conductor exposed portions of coaxial cables are matched with a first cable holder. A second cable holder is reversed on the first cable holder, and is engaged therewith. The engagement is further engaged with a housing. Central conductors of the inner insulator exposed portions are engaged with cuts of first contact elements. The outer conductor exposed portions are held in gripping conductors that are disposed inside the first cable holder. Gripping conductor extensions that are coupled with the gripping conductors are engaged with cuts of second contact elements. The contact elements are connected to external cable connection terminals that extend within a connection chamber of the housing.

7 Claims, 5 Drawing Sheets

U.S. PATENT DOCUMENTS

| | | | | |
|---|---|---|---|---|
| 7,074,093 | B2 * | 7/2006 | Saka et al. | 439/724 |
| 2001/0012721 | A1 * | 8/2001 | Nagai | 439/404 |

FOREIGN PATENT DOCUMENTS

| | | | |
|---|---|---|---|
| EP | 0590796 | | 4/1994 |
| EP | 0793296 | | 9/1997 |
| GB | 2254495 | | 10/1992 |
| GB | 2261328 | A | 5/1993 |
| JP | 4-14858 | | 1/1992 |
| JP | 5-135825 | | 6/1993 |
| JP | 2000-12109 | A | 1/2000 |
| WO | WO 99/66598 | | 12/1999 |

* cited by examiner

COAXIAL CABLE CONNECTOR, AND HARNESS UNIT THAT UTILIZES THE COAXIAL CABLE CONNECTOR

DETAILED DESCRIPTION OF THE INVENTION

1. Technical Field to which the Invention Belongs

The present invention relates to a coaxial cable connector that connects a coaxial cable, and a harness unit that uses the coaxial cable connector.

2. Prior Art

A coaxial cable comprising a central conductor, an inner insulating member that surrounds the central conductor, an outer conductor that surrounds the inner insulating member for shielding the central conductor, and an outer insulating member that surrounds the outer conductor has been used in various fields. For example, the coaxial cable is used to connect various kinds of measuring apparatuses in research organizations, and is used to connect electronic appliances at home.

In order to connect this coaxial cable with various kinds of apparatuses, or other coaxial cables, what is called a BNC connector is used. The BNC connector comprises an inner member that is connected to the coaxial cable, and an outer ring that is rotatably fitted to the outside of the inner member and has slanted notches to be engaged with an external terminal.

When the BNC connector is used, at the front end of the coaxial cable, a central conductor exposed portion with a predetermined length is formed, in which only the central conductor is left and the inner insulating member, the outer conductor, and the outer insulating member at the outside of the central conductor are removed from the surface. Further, an outer conductor exposed portion with a predetermined length is formed continuing from the rear end of the central conductor exposed portion, in which the central conductor, the inner insulating member, and the outer conductor are left and only the external insulating member is removed from the surface.

A central terminal of the BNC connector is pressed against the central conductor of the full peel-off portion. While the central terminal is inserted into a coaxial cable connection cylinder at the rear end of the inner member of the BNC connector, the outer conductor of the outer conductor exposed portion is disentangled, and this disentangled portion is roughly covered on the outside of the cylinder. Thereafter, a caulking member set in advance on an original diameter portion is moved, and the front end of the caulking member is covered on the outside of the disentangled outer conductor. The rear end is crushed, and is bitten into the original diameter portion. Thus, a complex work is necessary. The BNC connector can be connected to only one coaxial cable.

Coaxial connector cables that can be combined with a plurality of coaxial cables are disclosed in a patent literature 1 (Japanese Patent Application Laid-open Publication No. 5-135825), and a patent literature 2 (Japanese Utility Model Application Laid-open Publication No. 4-14858). While these coaxial cable connectors can connect a plurality of coaxial cables, each coaxial cable connector requires a soldering of a outer conductor to a cable supporting member. Consequently, the outer conductors of a plurality of coaxial cables are integrally combined, and are made electrically common. As a result, when a shield of one coaxial cable is degraded, the shields of all the other coaxial cables are also degraded.

[Patent literature 1]

Japanese Patent Application Laid-open Publication No. 5-135825

[Patent literature 2]

Japanese Utility Model Application Laid-open Publication No. 4-14858

PROBLEMS TO BE SOLVED BY THE INVENTION

It is an object of the present invention to provide a coaxial cable connector that can be easily fitted to one or a plurality of coaxial cables, and that can secure an independent shield.

MEANS FOR SOLVING THE PROBLEMS

In one embodiment according to the invention, there is provided a coaxial cable connector comprising, a first cable holder, a second cable holder which can be engaged to said first cable holder by pressing, a housing to which an assembly by engaging said first cable holder and said second cable holder, at least one gripping conductors and gripping conductor extensions extending therefrom which are located in said first cable holder in an insulated condition, and, a plurality of contact elements and external cable connection terminals connected thereto which are located in said housing in an insulated condition, wherein, each cable holder has grooves for receiving an inner insulator exposed portion and an outer conductor exposed portion of the coaxial cable formed at one end thereof, said gripping conductors each grips said outer conductor exposed portion of the coaxial cable, said gripping conductor extensions each engages with a corresponding contact element, and a central conductor of the coaxial cable in the outer conductor exposed portion engages with a corresponding contact element.

According to the coaxial cable connector having the above structure, it is possible to easily fit the coaxial cable by engagement based on pressing, and the central conductor and the outer conductor of the coaxial cable are connected to external cable connection terminal in an insulated condition. Therefore, even when a plurality of coaxial cables are fitted, it is possible to separately secure individual shieldings.

In another embodiment according to the invention, said first cable holder comprises:

a block body;

at least one first inner insulator exposed portion receiving grooves that is formed on a first surface of the block body and receives approximately half of a cross-sectional portion of the inner insulator exposed portion of the coaxial cable;

at least one first outer conductor exposed portion receiving grooves that is formed to continue from a rear end of the first inner insulator exposed portion receiving groove and receives approximately half of a cross-sectional portion of the outer conductor exposed portion of the coaxial cable;

at least one first original-diameter end portion receiving grooves that is formed to continue from a rear end of the first outer conductor exposed portion receiving groove, and receives approximately half of a cross-sectional portion of an original-diameter end portion;

wherein, said gripping conductor is disposed in the first outer conductor exposed portion receiving groove, and said gripping conductor extension extends from said gripping conductor to a direction of the front end of the coaxial cable in parallel with the first outer conductor exposed portion receiving groove, said second cable holder comprises:

a block body;

at least one second inner insulator exposed portion receiving grooves equal in number to the number of the first inner insulator exposed portion receiving groove of the first cable holder, that is formed on a first surface of the block body and receives approximately half of a cross-sectional portion of the inner insulator exposed portion of the coaxial cable;

at least one second outer conductor exposed portion receiving grooves that is formed to continue from a rear end of the second inner insulator exposed portion receiving groove and receives approximately half of a cross-sectional portion of the outer conductor exposed portion of the coaxial cable; and at least one second original-diameter end portion receiving grooves that is formed to continue from a rear end of the second outer conductor exposed portion receiving groove, and receives approximately half of a cross-sectional portion of the original diameter portion of the coaxial cable, wherein, after positioning the outer conductor exposed portion of the coaxial cable to be matched with a position of the gripping conductor of the first cable holder, the first surface of the first cable holder being pressed against the first surface of the second cable holder to face each other so that they are engaged with each other and the second outer conductor exposed portion receiving groove presses the gripping conductor in deformation and thereby grip the outer conductor exposed portion of the coaxial cable, said housing comprises:

a block body, to which said assembly by engaging said first cable holder and said second cable holder are engaged by pressing;

at least one first contact elements equal in number to the number of the first inner insulator exposed portion receiving groove of the first cable holder, mounted on a first surface of the block body and is capable of engaging with the central conductor of the inner insulator exposed portion of the coaxial cable at the engagement time; and at least one second contact elements equal in number to the number of the first inner insulator exposed portion receiving groove of the first cable holder, mounted on the first surface of the block body and is capable of engaging with the gripping conductor extension that is disposed on the first cable holder upon engagement, wherein, said first contact element being connected to an insulated external cable connection terminal for the central conductor via an insulated connection member for said first contact element, and said second contact element being connected to an insulated external cable connection terminal for the outer conductor via an insulated connection member for said second contact element, wherein said first cable holder and said second cable holder are fitted with complementary engaging units respectively for mutually engaging the two cable holders, and at least one of the first cable holder and the second cable holder, and the housing are provided with complementary engaging units respectively for mutually engaging the cable holder assembly and the housing.

In another embodiment according to the invention, the first contact element and the second contact element have cuts formed on plate members that are mounted on the block body of the housing respectively.

In another embodiment according to the invention, the gripping conductor extension has projections that stretch perpendicularly in a longitudinal direction, and the projections are engaged with holes formed on the first cable holder, and are held at predetermined positions.

In another embodiment according to the invention, the gripping conductor has projections that stretch perpendicularly in a longitudinal direction, and the projections are engaged with holes formed on the first cable holder, and are held at predetermined positions.

In another embodiment according to the invention, the gripping conductor has a pressed portion that is pressed and deformed, and a base portion to which one side of the pressed portion is integrally connected, the gripping conductor extension is connected to a first end of the base portion near the front end of the coaxial cable, and staged projections that bite into the original-diameter end portion and are capable of gripping the original-diameter portion are formed on a second end of the base portion far from the front end of the coaxial cable.

In another embodiment according to the invention, a coaxial cable harness unit is formed by using any one of the embodiments of the coaxial cable connectors.

EMBODIMENTS OF THE INVENTION

Embodiments of the present invention will be explained below with reference to the accompanying drawings.

FIG. 1 is a perspective view that shows a state before a coaxial cable connector 1 according to the present invention fits coaxial cables. The coaxial cable connector 1 can fit two coaxial cables. The coaxial cable connector 1 includes a first cable holder 100, a second cable holder 200, and a housing 300 that are formed by using an insulating resin material respectively. The first cable holder 100 and the second cable holder 200 are coupled together with two flexible and foldable coupling members 2. The second cable holder 200 and the housing 300 are also coupled together with two flexible and foldable coupling members 3.

A reference symbol 101 denotes a block body of the first cable holder 100, a reference symbol 201 denotes a block body of the second cable holder 200, and a reference symbol 301 denotes a block body of the housing 300. The side in which outgoing lines for reference symbols are provided, that is, the upper side in FIG. 1, will be called a front end. The opposite side, that is, the lower side in FIG. 1, will be called a rear end.

The upward-facing surfaces of the block body 101 of the first cable holder 100, the block body 201 of the second cable holder 200, and the block body 301 of the housing 300 will be called first surfaces respectively. The opposite surfaces will be called second surfaces. Reference symbols of these surfaces are omitted.

FIG. 2 shows a processing state of the front ends of two coaxial cables 10*a* and 10*b* respectively that are fitted to the coaxial cable connector 1. The coaxial cables 10*a* and 10*b* comprise central conductors 11*a* and 11*b*, inner insulating members 12*a* and 12*b* that surround the outside of the central conductors 11*a* and 11*b*, outer conductors 13*a* and 13*b* that surround the outside of the inner insulating members 12*a* and 12*b*, and external insulating members 14 and 14*b* that surround the outside of the outer conductors 13*a* and 13*b*, respectively.

Each of the central conductors 11*a* and 11*b* is made of one conductor. In the present embodiment, the outer conductors

13*a* and 13*b* are mesh conductors. It is also possible to form the outer conductors 13*a* and 13*b* by using a lateral winding conductor, a metal pipe, metal foil, a metal-deposited film, or the like.

Inner insulator exposed portions 15*a* and 15*b* that have the outer insulating members 14*a* and 14*b* peel-off from the surface respectively are formed to have a predetermined length L1 from the front end. Outer conductor exposed portions 16*a* and 16*b* that have only the outer insulating members 14*a* and 14*b* peel-off from the surface respectively are formed to continue from the rear end of the inner insulator exposed portions 15*a* and 15*b*, to have a predetermined length L2. Portions having the original diameters that have none of the portions of the coaxial cables 10*a* 10*b* peel-off and continue from the rear end of the outer conductor exposed portions 16*a* and 16*b* are called original-diameter end portions 17*a* and 17*b* respectively.

Referring back to FIG. 1, details of the first cable holder 100 will be explained. The first cable holder 100 is formed with first inner insulator exposed portion receiving grooves 110*a* and 110*b* that receive approximately half of the cross-sectional portion of the inner insulator exposed portions 15*a* and 15*b* of the coaxial cables 10*a* and 10*b* respectively. The first cable holder 100 is further formed with first outer conductor exposed portion receiving grooves 120*a* and 120*b* that continue from the rear end of the first inner insulator exposed portion receiving grooves 110*a* and 110*b*, and receive approximately half of the cross-sectional portion of the outer conductor exposed portions 16*a* and 16*b* of the coaxial cables 10*a* and 10*b* respectively. The first cable holder 100 is further formed with first original-diameter end portion receiving grooves 130*a* and 130*b* that continue from the rear end of the first outer conductor exposed portion receiving grooves 120*a* and 120*b*, and receive approximately half of the cross-sectional portion of the original-diameter end portions 17*a* and 17*b* of the coaxial cables 10*a* and 10*b* respectively.

Each of the first inner insulator exposed portion receiving grooves 110*a* and 110*b* has a length approximately equal to the length L1 shown in FIG. 2. Each of the first outer conductor exposed portion receiving grooves 120*a* and 120*b* has a length approximately equal to the length L2 shown in FIG. 2.

Each of the first inner insulator exposed portion receiving grooves 11*a* and 11*b* has an approximately arcuate cross section. The front end of each of the first inner insulator exposed portion receiving grooves 110*a* and 110*b* is closed with a front end wall 102. At positions near the front end wall 102, confirmation holes 111*a* and 111*b* are formed on the bottoms of the grooves to pierce through the second surface side. An operator can confirm through these confirmation holes 111*a* and 111*b* whether the coaxial cables 10*a* and 10*b* are disposed at predetermined positions such that the front ends of the inner insulator exposed portions 15*a* and 15*b* are brought into contact with the front end wall 102 respectively.

Further, there are formed first contact element through-holes 112*a* and 112*b* through which first contact elements 330*a* and 330*b* that are fitted on the housing 300 pass when a cable holder assembly 400 (refer to FIG. 5), which is an engagement of the first cable holder 100 and the second cable holder 200, is engaged with the housing 300.

Next, details of the first outer conductor exposed portion receiving grooves 120*a* and 120*b* will be explained. Each of the first outer conductor exposed portion receiving grooves 120*a* and 120*b* has a U-shaped cross section on a flat bottom. Gripping conductors 140*a* and 140*b* that grip the outer conductor exposed portions 16*a* and 16*b* of the coaxial cables 10*a* and 10*b* respectively are disposed on the first outer conductor exposed portion receiving grooves 120*a* and 120*b*. Gripping conductor extensions 150*a* and 150*b* are integrally connected to the front end of the gripping conductors 140*a* and 140*b*, and extend to the front end respectively. The gripping conductor extensions 150*a* and 150*b* are disposed in gripping conductor extension receiving grooves 160*a* and 160*b* that are formed on the first surface of the block body 101 between the two first inner insulator exposed portion receiving grooves 110*a* and 110*b*.

Further, there are formed second contact element through-holes 161*a* and 161*b* through which second contact elements 340*a* and 340*b* that are fitted on the housing 300 pass when the cable holder assembly 400 (refer to FIG. 5), which is the engagement of the first cable holder 100 and the second cable holder 200, is engaged with the housing 300, such that the second contact element through-holes 161*a* and 161*b* are orthogonal with the gripping conductor extension receiving grooves 160*a* and 160*b* respectively.

FIG. 3 shows the gripping conductors 140*a* and 140*b*, and the gripping conductor extensions 150*a* and 150*b* that are integrally fitted to them. The gripping conductors 140*a* and 140*b* have pressed portions 141*a* and 141*b* that are pressed and deformed when the first cable holder 100 and the second cable holder 200 are engaged together, and base portions 142*a* and 142*b* that are connected to one side of the pressed portions 141*a* and 141*b* respectively and are mounted on the bottoms of the first outer conductor exposed portion receiving grooves 120*a* and 120*b*.

Projections 143*a* and 143*b* are fitted on the base portions 142*a* and 142*b*, and projections 151*a* and 151*b* are fitted on the gripping conductor extensions 150*a* and 150*b*, respectively. These projections are engaged with corresponding holes (not shown) that are formed on the block body 110, so that the gripping conductors 140*a* and 140*b* and the gripping conductor extensions 150*a* and 150*b* are set at predetermined positions.

Staged projections 144*a* and 144*b* are formed on the ends of the rear end of the base portions 142*a* and 142*b* respectively. At the time of engaging the first cable holder 100 and the second cable holder 200 together, the projections 144*a* and 144*b* bite into the original-diameter end portions 17*a* and 17*b* of the coaxial cables 10*a* and 10*b*, and grip the original-diameter end portions 17*a* and 17*b*.

Referring back to FIG. 1, the details of the first original-diameter end portion receiving grooves 130*a* and 130*b* will be explained. The first original-diameter end portion receiving grooves 130*a* and 130*b* have approximately arc-shaped cross sections respectively. Bottom projections 131*a* and 131*b* are provided on the bottoms of the first original-diameter end portion receiving grooves 130*a* and 130*b* respectively. First side projections 132*a* and 132*b* and second side projections 133*a* and 133*b* are formed at upper ends of mutually opposite side walls. These projections have a function of biting into the original-diameter end portions 17*a* and 17*b* of the coaxial cables 10*a* and 10*b* and gripping the original-diameter end portions 17*a* and 17*b*, at the time of engaging the first cable holder 100 and the second cable holder 200 together. The first side projections 132*a* and 132*b* and the second side projections 133*a* and 133*b* also have a function of temporarily fixing the coaxial cables 10*a* and 10*b* thereby to prevent them from moving at a first setting of the coaxial cables.

First projections 103*a* and 103*b* and second projections 104*a* and 104*b* (not shown in FIG. 1) are formed on the external sides of the first inner insulator exposed portion receiving grooves 110*a* and 110*b* respectively, and third projections 105*a* and 105*b* are formed on the upper sides respectively. Fourth projections 106*a* and 106*b* and fifth projections 107*a* and 107*b* are formed on the external sides of the original-diameter end portion receiving grooves 130*a* and 130*b* respectively.

Next, details of the second cable holder 200 will be explained.

The second cable holder 200 is formed with second inner insulator exposed portion receiving grooves 210*a* and 210*b* that receive approximately the remaining half of the cross-sectional portion of the inner insulator exposed portions 15*a* and 15*b* of the coaxial cables 10*a* and 10*b* respectively. The second cable holder 200 is further formed with second outer conductor exposed portion receiving grooves 220*a* and 220*b* that continue from the rear end of the second inner insulator exposed portion receiving grooves 210*a* and 210*b*, and receive approximately the remaining half of the cross-sectional portion of the outer conductor exposed portions 16*a* and 16*b* of the coaxial cables 10*a* and 10*b* respectively. The first cable holder 200 is further formed with second original-diameter end portion receiving grooves 230*a* and 230*b* that continue from the rear end of the second outer conductor exposed portion receiving grooves 220*a* and 220*b*, and receive approximately the remaining half of the cross-sectional portion of the original-diameter end portions 17*a* and 17*b* of the coaxial cables 10*a* and 10*b* respectively.

Each of the second inner insulator exposed portion receiving grooves 210*a* and 210*b* has a length approximately equal to the length L1 shown in FIG. 2. Each of the second outer conductor exposed portion receiving grooves 220*a* and 220*b* has a length approximately equal to the length L2 shown in FIG. 2.

The second cable holder 200 is reversed such that the first surface thereof is brought into contact with the first surface of the first cable holder 100, and the second cable holder 200 is engaged with the first cable holder 100. Therefore, in FIG. 1, reference symbols that have "a" are shown at the right side, and reference symbols that have "b" are shown at the left side, opposite to those of the first cable holder 100.

Each of the second inner insulator exposed portion receiving grooves 210*a* and 210*b* has an approximately arcuate cross section. The front end of each of the second inner insulator exposed portion receiving grooves 210*a* and 210*b* is closed with front end walls 202*a* and 202*b* respectively. At positions near the front end walls 202*a* and 202*b*, confirmation holes 211*a* and 211*b* are formed on the bottoms of the grooves to pierce through the second surface side. An operator can also confirm through these confirmation holes 211*a* and 211*b* whether the coaxial cables 10*a* and 10*b* are disposed at predetermined positions such that the front ends of the inner insulator exposed portions 15*a* and 15*b* are brought into contact with the front end walls 202*a* and 202*b* respectively.

There are formed first contact element through-holes 212*a* and 212*b* through which first contact elements 330*a* and 330*b* that are fitted on the housing 300 pass when the cable holder assembly (refer to FIG. 5), which is the engagement of the first cable holder 100 and the second cable holder 200, is engaged with the housing 300.

Further, between the two second inner insulator exposed portion receiving grooves 210 and 210*b*, there are formed second contact element through-holes 250*a* and 250*b* through which the second contact elements 340*a* and 340*b* that are fitted on the housing 300 pass when the cable holder assembly (refer to FIG. 5), which is the engagement of the first cable holder 100 and the second cable holder 200, is engaged with the housing 300.

Each of the second outer conductor exposed portion receiving grooves 220*a* and 220*b* has basically a cross section of approximately an arcuate shape. The second outer conductor exposed portion receiving grooves 220*a* and 220*b* further have clearance grooves 221*a* and 221*b* respectively so that the pressed portions 141*a* and 141*b* of the gripping conductors 140*a* and 140*b* can suitably bend at the time of engaging the first cable holder 100 and the second cable holder 200 together.

The second original-diameter end portion receiving grooves 230*a* and 230*b* have approximately arc-shaped cross sections respectively. Bottom projections 231*a* and 231*b* are provided on the bottoms of the second original-diameter end portion receiving grooves 230*a* and 230*b* respectively. These projections have a function of biting into the original-diameter end portions 17*a* and 17*b* of the coaxial cables 10*a* and 10*b* and gripping the original-diameter end portions 17*a* and 17*b*, at the time of engaging the first cable holder 100 and the second cable holder 200 together.

First projections 203*a* (not shown in FIG. 1) and 203*b*, second projections 204*a* (not shown in FIG. 1) and 204*b*, third projections 205*a* and 205*b*, and cuts 206*a* and 206*b* are formed on the external sides of the second inner insulator exposed portion receiving grooves 210*a* and 210*b* of the second cable holder 200 respectively.

L-shaped first arms 241*a* and 241*b*, second arms 242*a* and 242*b*, and third arms 243*a* and 243*b* are provided on the external sides of the second outer conductor exposed portion receiving grooves 220*a* and 220*b* and the second original-diameter end portion receiving grooves 230*a* and 230*b* respectively. The front ends of these arms cross-linked with bars 244*a* and 244*b* respectively. The first arms 241*a* and 241*b* are provided with fourth projections 207*a* (not shown in FIG. 1) and 207*b* respectively. The bars 244*a* and 244*b* are provided with fifth projections 208*a* (not shown in FIG. 1) and 208*b* respectively.

Details of the housing 300 will be explained next.

A first chamber 310 is provided at the front end, and a second chamber 320 is provided at the rear end, of the block body 301 of the housing 300 respectively.

The first contact elements 330*a* and 330*b* and the second contact elements 340*a* and 340*b* are fitted within the first chamber 310. A method of fitting the contact elements will be explained below.

FIG. 4 is a perspective view of the first contact elements 330*a* and 330*b* and the second contact elements 340*a* and 340*b*. First contact element connection members 350*a* and 350*b* and second contact element connection members 360*a* and 360*b* are fitted to the lower ends of the first contact elements 330*a* and 330*b* and the second contact elements 340*a* and 340*b* respectively. The first contact element connection members 350*a* and 350*b* and the second contact element connection members 360*a* and 360*b* extend to the front end, and their front ends are bent upward respectively. External cable connecting terminals 370*a*, 370*b*, 380*a*, and 380*b* are fitted to the front ends of these connection members.

The first contact elements 330*a* and 330*b* and the second contact elements 340*a* and 340*b* are engaged with grooves 311*a*, 311*b*, 312*a*, and 312*b* that are formed on the bottom of the first chamber 310 respectively. The external cable connection terminals 370*a*, 370*b*, 380*a*, and 380*b* pass through holes (not shown) formed in advance on an end wall 302 of the block body 301, and reach a connection chamber (not shown) into which other connectors formed at the front end of the end wall 302 are inserted. The first contact elements 330*a* and 330*b* and the second contact elements 340*a* and 340*b* are positioned and their postures are held in this way.

The first contact elements 330*a* and 330*b* and the second contact elements 340*a* and 340*b* are formed with cuts 332*a*, 332*b*, 342*a*, and 342*b* that lead toward the bottom of the block body 301 from the upper end in the drawing, on plate members 331*a*, 331*b*, 341*a*, and 341*b* respectively. Thin acuminate cutting edges 333*a*, 333*b*, 343*a*, and 343*b* are formed at the upper ends of the plate members 331*a*, 331*b*, 341*a*, and 341*b* respectively.

The first contact elements 330*a* and 330*b* and the second contact elements 340*a* and 340*b* are mutually the same, and the external cable connection terminals 370*a*, 370*b*, 380*a*, and 380*b* are also mutually the same. However, the first contact element connection members 350*a* and 350*b* and the second contact element connection members 360*a* and 360*b* have mutually different lengths as shown in the drawing, and the short connection members and the long connection members are alternately arranged. With this arrangement, it is possible to narrow the width while preventing the occurrence of a short-circuiting.

On the side wall of the first chamber 310, there are formed first grooves 303*a* and 303*b* (not shown in FIG. 1) of which upper sides are closed in the drawing, second grooves 304*a* and 304*b* (not shown in FIG. 1) of which upper sides are opened in the drawing, and third grooves 305*a* and 305*b* (not shown in FIG. 1) of which upper sides are closed in the drawing, respectively.

On the side wall of the second chamber 320, there are formed fourth grooves 307*a* and 307*b* of which upper sides are opened in the drawing, and fifth grooves 308*a* and 308*b* (not shown in FIG. 1) of which upper sides are closed in the drawing, respectively. First bottom projections 321*a* and 321*b* and second bottom projections 322*a* and 322*b* are formed on the bottom wall of the second chamber 320 respectively. Large cuts 306*a* and 306*b* are formed to separate the first chamber 310 from the second chamber 320.

A process of connecting the coaxial cables 10*a* and 10*b* to the coaxial cable connector 1 that has the first cable holder 100, the second cable holder 200, and the housing 300 that are formed as explained above will be explained next.

First, the inner insulator exposed portions 15*a* and 15*b* and the outer conductor exposed portions 16*a* and 16*b* of the coaxial cables 10*a* and 10*b* prepared as shown in FIG. 2 are pressed into the first inner insulator exposed portion receiving grooves 110*a* and 110*b* and the first outer conductor exposed portion receiving grooves 120*a* and 120*b* of the first cable holder 100 respectively to match each other, and are set.

At this time, the first side projections 132*a* and 132*b* and the second side projections 133*a* and 133*b* within the first original-diameter end portion receiving grooves 130*a* and 130*b* of the first cable holder 100 bite into the original-diameter end portions 17*a* and 17*b* of the coaxial cables 10*a* and 10*b* respectively. Therefore, these projections are fixed temporarily, and the coaxial cables 10*a* and 10*b* are not removed.

Next, the second cable holder 200 is reversed, and is covered on the first cable holder 100.

Then, while the bars 244*a* and 244*b* of the second cable holder 200 are expanded in a width direction, these bars slide down along the external sides of the fourth projections 106*a* and 106*b* and the fifth projections 107*a* and 107*b* of the first cable holder 100 respectively. The bars 244*a* and 244*b* enter the lower side of the fourth projections 106*a* and 106*b* and the fifth projections 107*a* and 107*b* of the first cable holder 100 in FIG. 1, and the engagement is completed.

In the state that the engagement is completed, the projections 131*a* and 131*b* of the first original-diameter end portion receiving grooves 130*a* and 130*b* of the first cable holder 100, and the projections 231*a* and 231*b* of the second original-diameter end portion receiving grooves 230*a* and 230*b* of the second cable holder 200 bite into the original-diameter end portions 17*a* and 17*b* of the coaxial cables 10*a* and 10*b* respectively. Consequently, the coaxial cables 10*a* and 10*b* are held strongly.

FIG. 5 shows a state that the first cable holder 100 and the second cable holder 200 have been engaged together in the manner as described above.

The engagement of the first cable holder 100 and the second cable holder 200 is called, a cable holder assembly 400.

Next, the cable holder assembly 400 is engaged with the housing 300.

The cable holder assembly 400 shown in FIG. 5 is reversed, and is engaged with the housing 300. In other words, the second cable holder 200 becomes beneath the housing 300, and is pressed into the housing 300.

First, the third projections 105*a* and 105*b* of the first cable holder 100 are temporarily engaged with the third grooves 305*a* and 305*b* of the housing 300 respectively.

Then, the first projections 203*a* and 203*b*, the second projections 204*a* and 204*b*, and the third projections 205*a* and 205*b* of the second cable holder 200 are engaged with the first grooves 303*a* and 303*b*, the second grooves 304*a* and 304*b*, and the third grooves 305*a* and 305*b* of the housing 300 respectively.

Among the above, the second projections 204*a* and 204*b* of the second cable holder 200, and the second grooves 304*a* and 304*b* of the housing 300 play the role of positioning elements.

Next, the first projections 103*a* and 103*b* and the second projections 104*a* and 104*b* of the first cable holder 100 are engaged with the first grooves 305*a* and 305*b* of the housing 300, following the first projections 203*a* and 203*b* and the third projections 205*a* and 205*b* of the second cable holder 200.

The first projections 203*a* and 203*b* and the third projections 205*a* and 205*b* of the second cable holder 200 are at the position of the same longitudinal direction as that of the first projections 103*a* and 103*b* and the second projections 104*a* and 104*b* of the first cable holder 100. Therefore, the first projections 203*a* and 203*b* and the third projections 205*a* and 205*b* of the second cable holder 200 achieve a second temporarily fixing work, following the temporarily fixing based on the third projections 105*a* and 105*b* of the first cable holder 100. Therefore, substantial engagement is effected between the first projections 103*a* and 103*b* and the second projections 104*a* and 104*b* of the first cable holder 100, and the first grooves 303*a* and 303*b*, and the third grooves 305*a* and 305*b* of the housing 300 respectively.

The third grooves 305*a* and 305*b* have large widths in a longitudinal direction so that both the third projections 105*a* and 105*b* of the first cable holder 100 and the third projections 205*a* and 205*b* of the second cable holder 200 are engaged with these groves.

At the same time, the fourth projections 207*a* and 207*b* of the second cable holder 200 are engaged with the fourth grooves 307*a* and 307*b* of the housing 300, thereby to carry out the positioning. The fifth projections 208*a* and 208*b* are engaged with the fifth grooves 308*a* and 308*b* of the housing 300 respectively.

The first bottom projections 321*a* and 321*b* and the second bottom projections 322*a* and 322*b* are formed on the bottom wall of the second chamber 320 such that these projections are engaged with the concavities formed between the first arms 241*a* and 241*b* and the second arms 142*a* and 242*b*, and with the concavities formed between the second arms 142*a* and 242*b* and the third arms 243*a* and 243*b* respectively.

The first contact element 330*a* passes though the first contact element through-hole 212*a* formed on the second inner insulator exposed portion receiving groove 210*a* of the second cable holder 200, and the first contact element through-hole 112*a* formed on the first inner insulator exposed portion receiving groove 110*a* of the first cable holder 100 respectively. At this time, the cutting edge 333*a* of the first contact element 330*a* cuts through the inner insulating member 12*a* of the inner insulator exposed portion 15*a* of the coaxial cable 10*a*, and the central conductor 11*a* is engaged with the cut 332*a*.

Similarly, the first contact element 330*b* passes though the first contact element through-hole 212*b* formed on the second inner insulator exposed portion receiving groove 210*b* of the second cable holder 200, and the first contact element through-hole 112*b* formed on the first inner insulator exposed portion receiving groove 110*b* of the first cable holder 100 respectively. At this time, the cutting edge 333*b* of the first contact element 330*b* cuts through the inner insulating member 12*b* of the inner insulator exposed portion 15*b* of the coaxial cable 10*b*, and the central conductor 11*b* is engaged with the cut 332*b*.

The second contact element 340*a* passes though the second contact element through-hole 250*a* formed on the second inner insulator exposed portion receiving groove 210*a* of the second cable holder 200, and the second contact element through-hole 161*a* formed on the first inner insulator exposed portion receiving groove 110*a* of the first cable holder 100. At this time, the gripping conductor extension 150*a* is engaged with the cut 342*a* of the second contact element 340*a*.

Similarly, the second contact element 340*b* passes though the second contact element through-hole 250*b* formed on the second inner insulator exposed portion receiving groove 210*b* of the second cable holder 200, and the second contact element through-hole 161*b* formed on the first inner insulator exposed portion receiving groove 10*b* of the first cable holder 100. At this time, the gripping conductor extension 150*b* is engaged with the cut 342*b* of the second contact element 340*b*.

FIG. 6 shows a state that the central conductors 12*a* and 12*b* are engaged with the cuts 332*a* and 332*b* of the first contact elements 330*a* and 330*b* respectively, and the gripping conductor extensions 150*a* and 150*b* are engaged with the cuts 342*a* and 342*b* of the second contact elements 340*a* and 340*b* respectively.

FIG. 7 shows a coaxial cable harness unit 500 that is completed by having the cable holder assembly 400 engaged with the housing 300. The coaxial cable harness unit 500 completed in this way is coupled with a connector of other cable or a connector provided in the device having terminals that are complementarily engaged with the external cable connection terminals 370*a*, 370*b*, 380*a*, and 380*b* within a connection chamber (not shown) of the housing 300.

The coaxial cable connector and the coaxial cable harness unit according to the present invention have been explained above. While the two coaxial cables are fitted, the routes from the respective signal transmission central conductors till the external cable connection terminals for the central conductors are disposed on the insulating resin material so that the routes are insulated. At the same time, the routes from the respective outer conductors till the external cable connection terminals for the outer conductors are also disposed on the insulating resin material so that the routes are insulated. As the outer conductors are not coupled together, it is possible to maintain the independence of the outer conductors. Therefore, even when the potential of one outer conductor becomes abnormal, this abnormal condition is not transmitted to all the other outer conductors.

EFFECTS OF THE INVENTION

In the coaxial cable embodiments according to the inventions described herein, it is possible to easily fit the coaxial cable by engagement based on pressing, and the central conductor and the outer conductor of the coaxial cable are connected to external cable connection terminal in an insulated condition. Therefore, even when a plurality of coaxial cables are fitted, it is possible to separately secure individual shieldings.

In coaxial cable harness embodiments described herein, a coaxial cable harness unit that utilizes any one of the above coaxial cable connectors is provided. Therefore, it is possible to easily connect the connector to the cable, and it is possible to secure excellent shields.

EXPLANATION OF SYMBOLS

Figure 1:
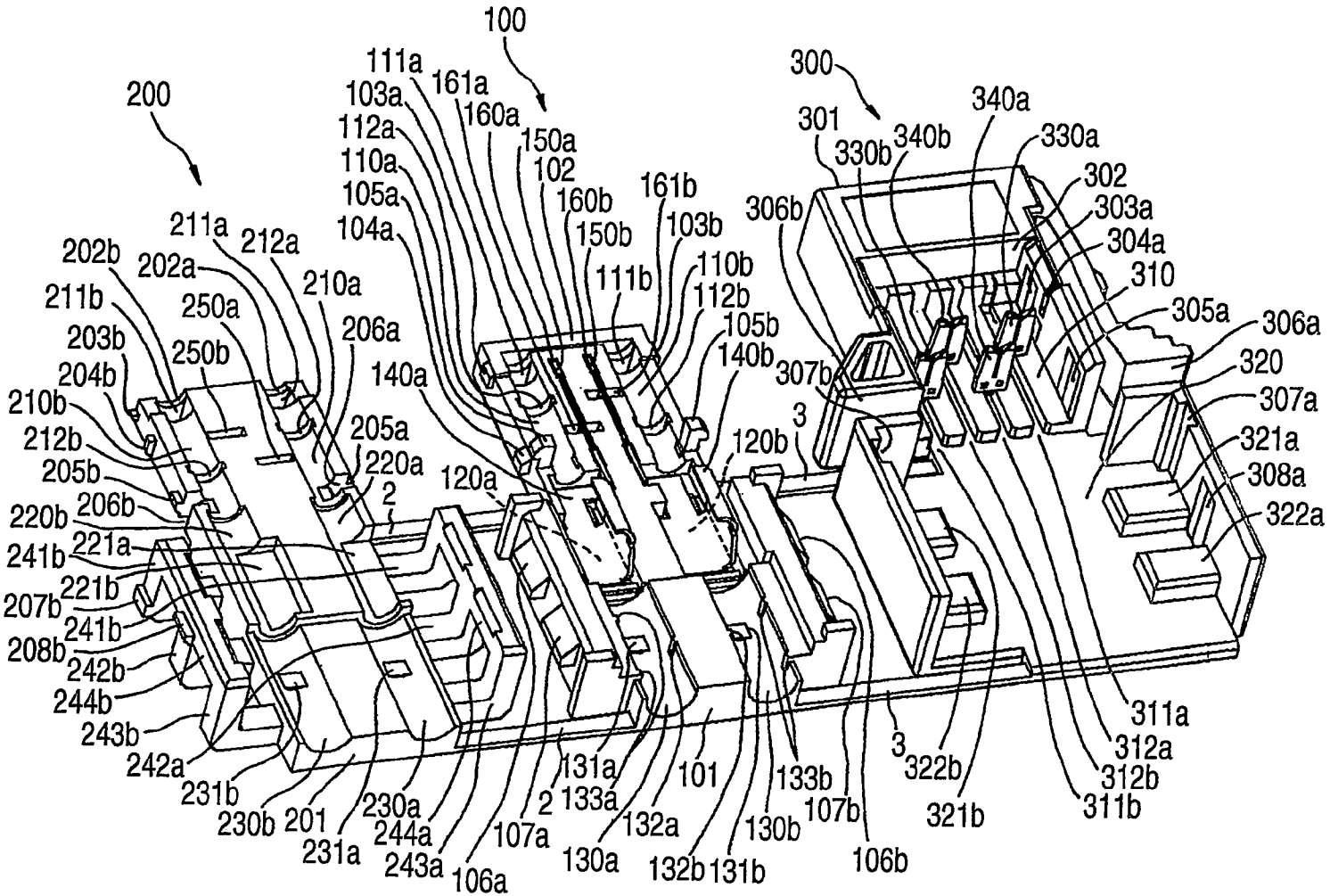
FIG. 1 is a perspective view that shows a structure of a coaxial cable connector having a first cable holder, a second cable holder, and a housing, according to the present invention.
Figure 2:
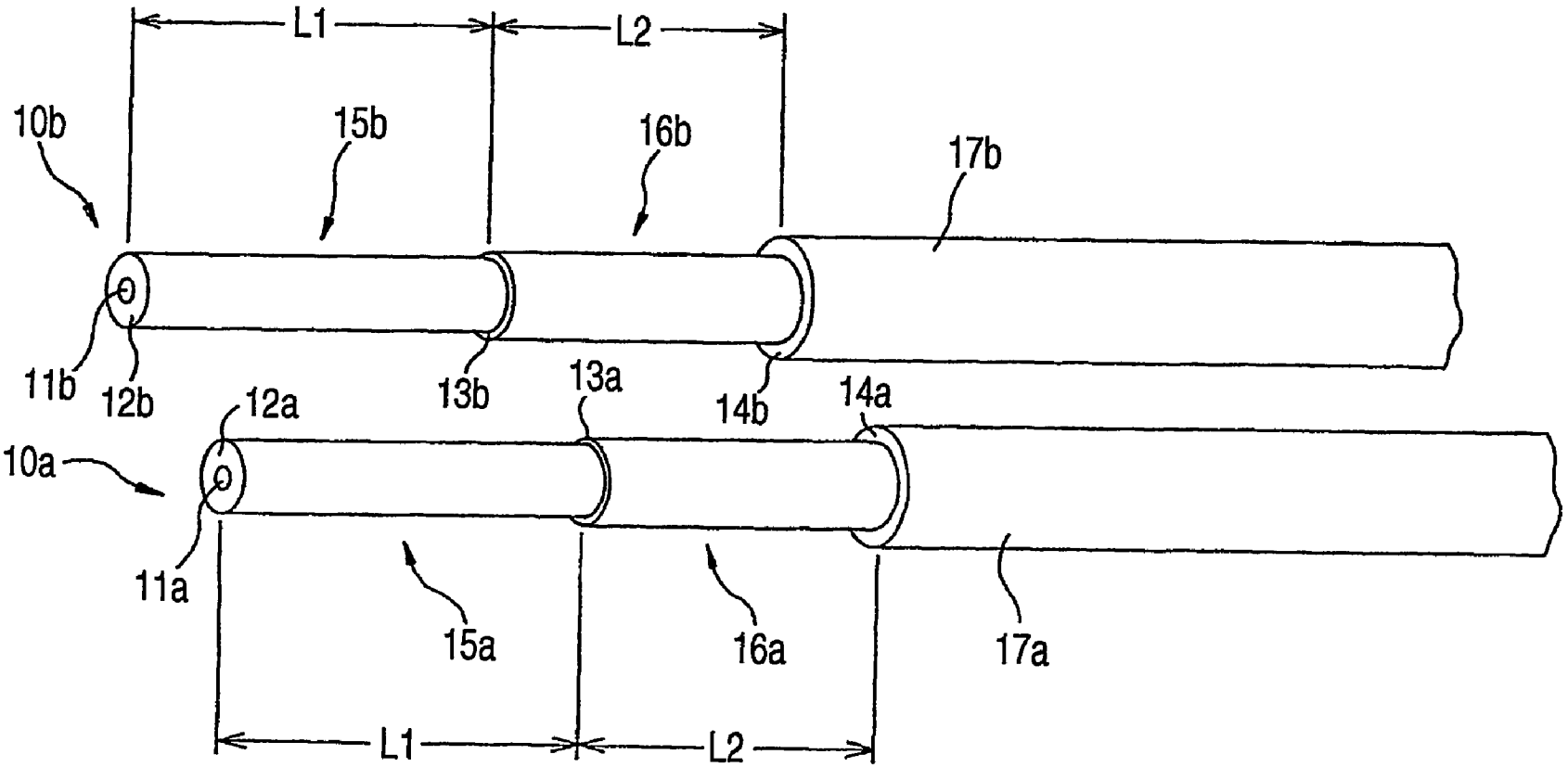
FIG. 2 shows a state of end portions of coaxial cables that are connected to the coaxial cable connector shown in FIG. 1.
Figure 3:
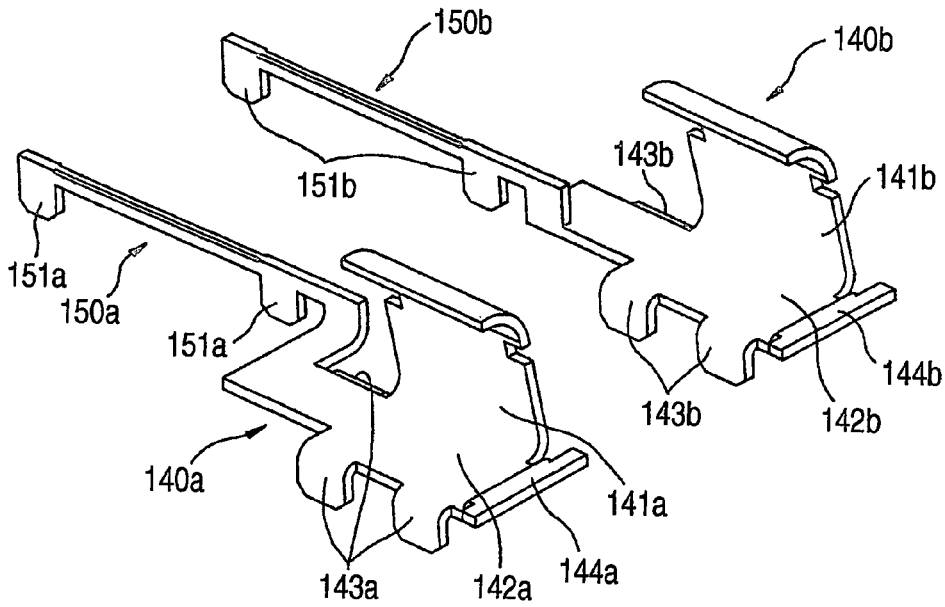
FIG. 3 shows gripping conductors and gripping conductor extensions that are fitted to the inside of the first cable holder.
Figure 4:
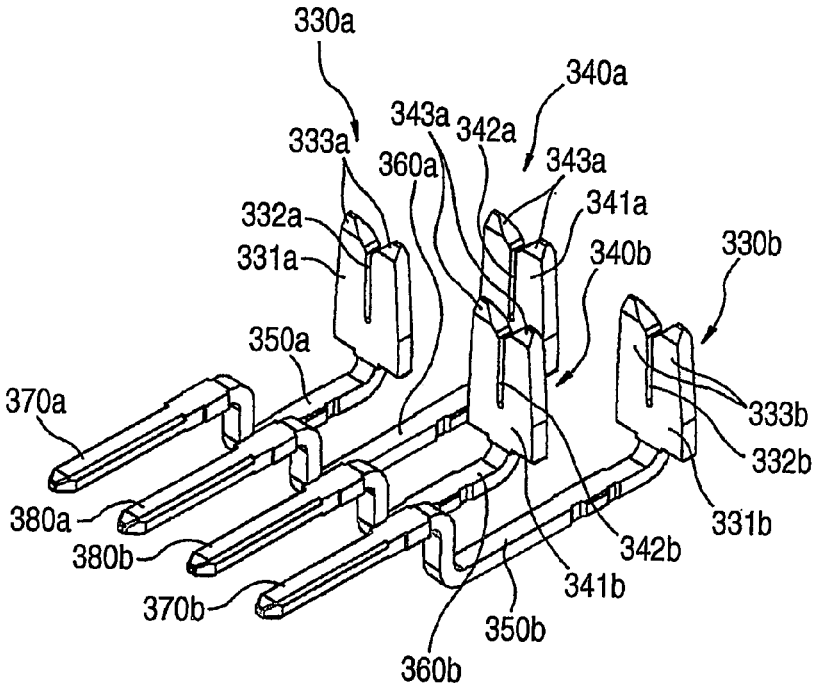
FIG. 4 shows contact elements, contact element connection members, and external cable connection terminals that are fitted to the housing.
Figure 5:
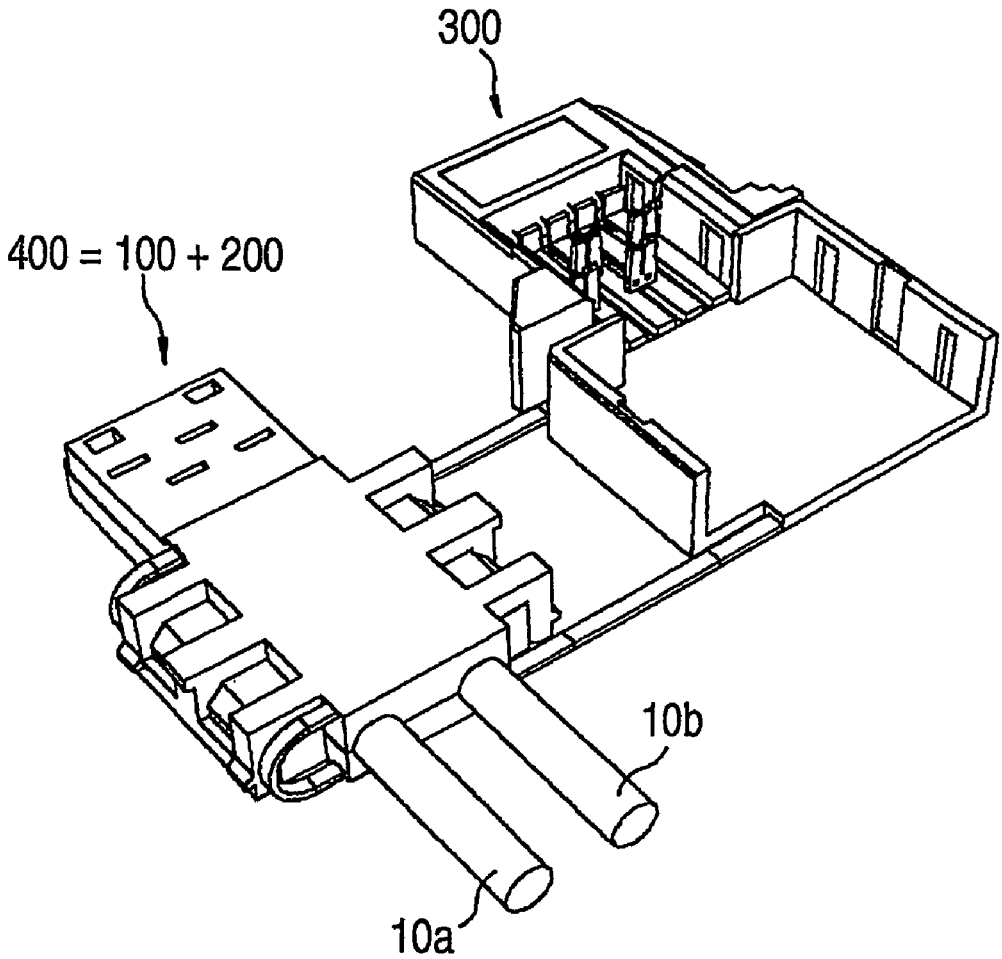
FIG. 5 shows a cable holder assembly that is the engagement of the first cable holder and the second cable holder, and the housing.
Figure 6:
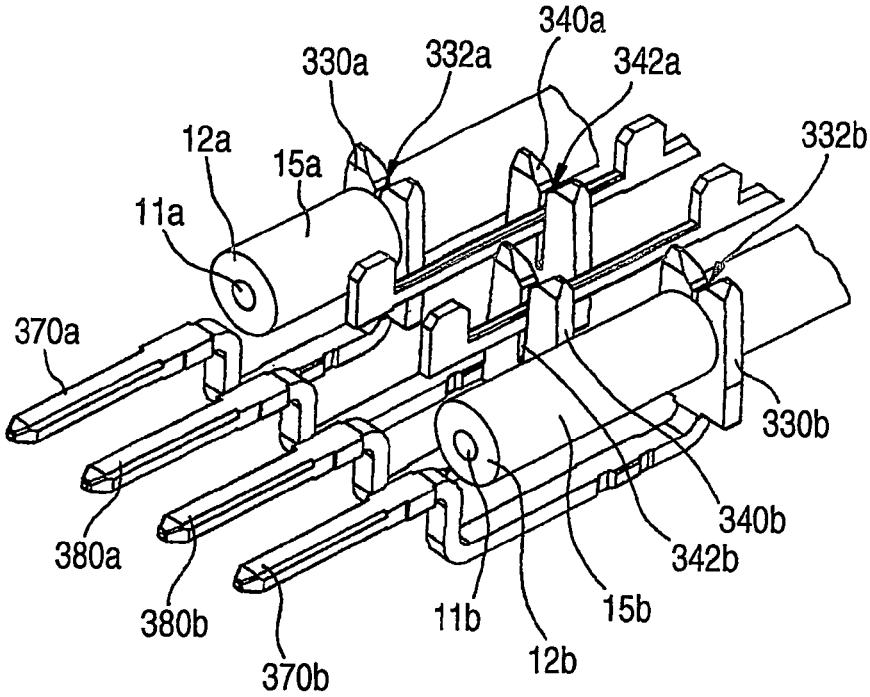
FIG. 6 shows a state that the contact elements, inner insulator exposed portions of the coaxial cables, and the gripping conductor extensions are engaged together.
Figure 7:
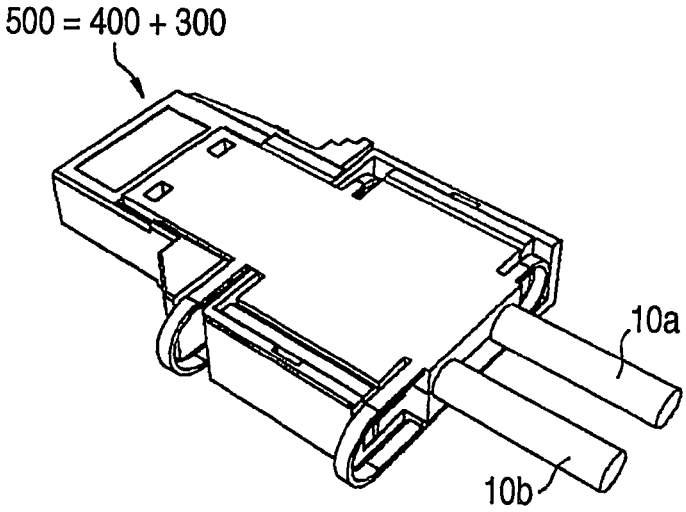
FIG. 7 shows a state that the cable holder assembly is engaged with the housing.

1 . . . coaxial cable connector
2, 3 . . . connection members
10*a*, 10*b* . . . coaxial cables
11*a*, 11*b* . . . central conductors
12*a*, 12*b* . . . inner insulating members
13*a*, 13*b* . . . outer conductors
14*a*, 14*b* . . . outer insulating members
15*a*, 15*b* . . . inner insulator exposed portions
16*a*, 16*b* . . . outer conductor exposed portions
17*a*, 17*b* . . . original-diameter end portions
100 . . . first cable holder

101 . . . block body
102 . . . front end wall
103*a*, 103*b* . . . first projections
104*a*, 104*b* . . . second projections
105*a*, 105*b* . . . third projections
106*a*, 106*b* . . . fourth projections
107*a*, 107*b* . . . fifth projections
110*a*, 110*b* . . . first inner insulator exposed portion receiving grooves
111*a*, 111*b* . . . confirmation holes
112*a*, 112*b* . . . (first contact element hole) through-holes
120*a*, 120*b* . . . first outer conductor exposed portion receiving grooves
130*a*, 130*b* . . . first original-diameter end portion receiving grooves
131*a*, 131*b* . . . bottom projections
132*a*, 132*b* . . . first side projections
133*a*, 133*b* . . . second side projections
140*a*, 140*b* . . . gripping conductors
141*a*, 141*b* . . . pressed members
142*a*, 142*b* . . . base portions
143*a*, 143*b* . . . projections
144*a*, 144*b* . . . (staged) projections
150*a*, 15*b* . . . gripping conductor extensions
151*a*, 51*b* . . . projections
160*a*, 160*b* . . . gripping conductor extension receiving grooves
161*a*, 61*b* . . . (second contact element) through-holes
200 . . . second cable holder
201 . . . block body
202*a*, 202*b* . . . front end walls
203*a*, 203*b* . . . first projection
204*a*, 204*b* . . . second projection
205*a*, 205*b* . . . third projection
206*a*, 206*b* . . . cuts
207*a*, 207*b* . . . fourth projection
208*a*, 208*b* . . . fifth projection
210*a*, 210*b* . . . second inner insulator exposed portion receiving grooves
211*a*, 211*b* . . . confirmation holes
212*a*, 212*b* . . . (first contact element) through-holes
220*a*, 220*b* . . . second outer conductor exposed portion receiving grooves
221*a*, 221*b* . . . gripping conductor clearance grooves
230*a*, 230*b* . . . first original-diameter end portion receiving grooves
231*a*, 231*b* . . . bottom projections
241*a*, 241*b* . . . first arms
242*a*, 242*b* . . . second arms
243*a*, 243*b* . . . third arms
244*a*, 244*b* . . . bars
250*a*, 250*b* . . . (gripping conductor extension) through-holes
300 . . . housing
301 . . . block body
302 . . . end wall
303*a*, 303*b* . . . first grooves
304*a*, 304*b* . . . second grooves
305*a*, 305*b* . . . third grooves
306*a*, 306*b* . . . cuts
307*a*, 307*b* . . . fourth grooves
308*a*, 308*b* . . . fifth grooves
310 . . . first chamber
311*a*, 311*b* . . . grooves
312*a*, 312*b* . . . grooves
320 . . . second chamber
321*a*, 321*b* . . . projections
322*a*, 322*b* . . . projections
330*a*, 330*b* . . . first contact elements
332*a*, 332*b* . . . cuts
333*a*, 333*b* . . . cutting edges
340*a*, 340*b* . . . second contact elements
342*a*, 342*b* . . . cuts
343*a*, 343*b* . . . cutting edges
350*a*, 350*b* . . . connection members
360*a*, 360*b* . . . connection members
370*a*, 370*b* . . . external cable connection terminals
380*a*, 380*b* . . . external cable connection terminals
400 . . . cable holder assembly
500 . . . coaxial cable harness unit

What is claimed is:

1. A coaxial cable connector comprising:

a first cable holder;

a second cable holder which can be engaged to said first cable holder by pressing;

a housing to which an assembly made by engaging of said first cable holder and said second cable holder can be engaged;

at least one gripping conductor and gripping conductor extension extending therefrom which are located in said first cable holder in an insulated condition; and, a plurality of contact elements and external cable connection terminals connected thereto which are located in said housing in an insulated condition, wherein, each cable holder has grooves for receiving an inner insulator exposed portion and an outer conductor exposed portion of a coaxial cable formed at one end thereof, said gripping conductor each grips said outer conductor exposed portion of the coaxial cable, and said gripping conductor extensions each engages with corresponding contact element, and a central conductor of the coaxial cable in the outer conductor exposed portion engages with corresponding contact element.

2. The coaxial cable connector according to claim 1, wherein the gripping conductor extension has projections that stretch perpendicularly in a longitudinal direction, and the projections are engaged with holes formed on the first cable holder, and are held at predetermined positions.

3. The coaxial cable connector according to claim 1, wherein the gripping conductor has projections that stretch perpendicularly in a longitudinal direction, and the projections are engaged with holes formed on the first cable holder, and are held at predetermined positions.

4. The coaxial cable connector according to claim 1, wherein the gripping conductor has a pressed portion that is pressed and deformed, and a base portion to which one side of the pressed portion is integrally connected, the gripping conductor extension is connected to a first end of the base portion near the front end of the coaxial cable, and staged projections that bite into the original-diameter end portion and are capable of gripping the original-diameter portion are formed on a second end of the base portion far from the front end of the coaxial cable.

5. A coaxial cable harness unit that is formed by using any one of the coaxial cable connectors according to claim 1.

6. A coaxial cable connector according to claim 1, wherein said first cable holder comprises:

a block body;

at least one first inner insulator exposed portion receiving grooves that is formed on a first surface of the block body and receives approximately half of a cross-sectional portion of the inner insulator exposed portion of the coaxial cable;

at least one first outer conductor exposed portion receiving grooves that is formed to continue from a rear end of the first inner insulator exposed portion receiving groove and receives approximately half of a cross-sectional portion of the outer conductor exposed portion of the coaxial cable;

at least one first original-diameter end portion receiving grooves that is formed to continue from a rear end of the first outer conductor exposed portion receiving groove, and receives approximately half of a cross-sectional portion of an original-diameter end portion;

wherein, said gripping conductor is disposed in the first outer conductor exposed portion receiving groove, and said gripping conductor extension extends from said gripping conductor to a direction of the front end of the coaxial cable in parallel with the first outer conductor exposed portion receiving groove, said second cable holder comprises:

a block body;

at least one second inner insulator exposed portion receiving grooves equal in number to the number of the first inner insulator exposed portion receiving groove of the first cable holder, that is formed on a first surface of the block body and receives approximately half of a cross-sectional portion of the inner insulator exposed portion of the coaxial cable;

at least one second outer conductor exposed portion receiving grooves that is formed to continue from a rear end of the second inner insulator exposed portion receiving groove and receives approximately half of a cross-sectional portion of the outer conductor exposed portion of the coaxial cable; and at least one second original-diameter end portion receiving grooves that is formed to continue from a rear end of the second outer conductor exposed portion receiving groove, and receives approximately half of a cross-sectional portion of the original diameter portion of the coaxial cable, wherein, after positioning the outer conductor exposed portion of the coaxial cable to be matched with a position of the gripping conductor of the first cable holder, the first surface of the first cable holder being pressed against the first surface of the second cable holder to face each other so that they are engaged with each other and the second outer conductor exposed portion receiving groove presses the gripping conductor in deformation and thereby grip the outer conductor exposed portion of the coaxial cable, said housing comprises:

a block body, to which said assembly by engaging said first cable holder and said second cable holder are engaged by pressing;

at least one first contact elements equal in number to the number of the first inner insulator exposed portion receiving groove of the first cable holder, mounted on a first surface of the block body and is capable of engaging with the central conductor of the inner insulator exposed portion of the coaxial cable at the engagement time; and at least one second contact elements equal in number to the number of the first inner insulator exposed portion receiving groove of the first cable holder, mounted on the first surface of the block body and is capable of engaging with the gripping conductor extension that is disposed on the first cable holder upon engagement, wherein, said first contact element being connected to an insulated external cable connection terminal for the central conductor via an insulated connection member for said first contact element, and said second contact element being connected to an insulated external cable connection terminal for the outer conductor via an insulated connection member for said second contact element, wherein, said first cable holder and said second cable holder are fitted with complementary engaging units respectively for mutually engaging the two cable holders, and at least one of the first cable holder and the second cable holder, and the housing are provided with complementary engaging units respectively for mutually engaging the cable holder assembly and the housing.

7. The coaxial cable connector according to claim 6, wherein the first contact element and the second contact element have cuts formed on plate members that are mounted on the block body of the housing respectively.

* * * * *

UNITED STATES PATENT AND TRADEMARK OFFICE

CERTIFICATE OF CORRECTION

PATENT NO. : 7,354,294 B2
APPLICATION NO. : 10/549960
DATED : April 8, 2008
INVENTOR(S) : Yoshihisa Kawate It is certified that error appears in the above-identified patent and that said Letters Patent is hereby corrected as shown below:

Column 5
Line 45, delete "11a" and insert -- 110a -- therefore.
Line 45, delete "11b" and insert -- 110b -- therefore.

Column 11
Line 48, delete "10b" and insert -- 110b -- therefore.

Signed and Sealed this

Fifteenth Day of July, 2008

JON W. DUDAS
*Director of the United States Patent and Trademark Office*